US008107656B2

(12) United States Patent
Dreβler et al.

(10) Patent No.: US 8,107,656 B2
(45) Date of Patent: Jan. 31, 2012

(54) LEVEL-DEPENDENT NOISE REDUCTION

(75) Inventors: Oliver Dreβler, Fürth (DE); Henning Puder, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1127 days.

(21) Appl. No.: 11/980,230

(22) Filed: Oct. 30, 2007

(65) Prior Publication Data

US 2008/0159573 A1 Jul. 3, 2008

(30) Foreign Application Priority Data

Oct. 30, 2006 (DE) ..... 10 2006 051 071

(51) Int. Cl.
*H04R 25/00* (2006.01)

(52) U.S. Cl. ..... 381/317; 381/320; 381/71.11; 381/94.7

(58) Field of Classification Search ..... 381/317, 381/320, 71.11, 94.7
See application file for complete search history.

(56) References Cited

U.S. PATENT DOCUMENTS 6,603,858 B1 * 8/2003 Raicevich et al. ..... 381/57
6,912,289 B2 6/2005 Vonlanthen et al.
2005/0078842 A1 4/2005 Vonlanthen et al.
2005/0096002 A1 * 5/2005 Klinke et al. ..... 455/302

FOREIGN PATENT DOCUMENTS

| | | | |
|---|---|---|---|
| DE | 37 33 983 | A1 | 4/1989 |
| DE | 698 16 610 | T2 | 6/2004 |
| DE | 10331956 | B3 | 1/2005 |
| WO | 9847315 | A1 | 10/1998 |
| WO | 0001198 | A1 | 1/2000 |

OTHER PUBLICATIONS

Iwasaki, "Automatic Noise Suppression in Hearing Aids", Hearing Aid Journal, Sioux City, Iowa, US, Dec. 1, 1981, pp. 10-11, 40, XP009027331, ISSN: 0091-2166.
Communication from European Patent Office, Apr. 14, 2011, pp. 1-7.

* cited by examiner

*Primary Examiner* — Tu-Tu Ho

(57) ABSTRACT

A method for noise reduction in a hearing aid device is described, with a signal, which comprises a useful and an interference signal part, being processed in the hearing aid device and with the interference signal part being reduced to the benefit of the useful signal part and with the reduction of the interference signal part being carried out as a function of the input level of the signal, with the interference signal part being more heavily attenuated with a high input level than with a low input level.

16 Claims, 2 Drawing Sheets

LEVEL-DEPENDENT NOISE REDUCTION

CROSS REFERENCE TO RELATED APPLICATIONS

This application claims priority of German application No. 102006051071.2 DE filed Oct. 30, 2006, which is incorporated by reference herein in its entirety.

FIELD OF INVENTION

The invention relates to a method for noise reduction in hearing aid devices, with which the effect of noise reduction is adjusted as a function of the current level.

BACKGROUND OF INVENTION

Modern hearing aids comprise signal processing concepts, with the aid of which audio signals can be processed not only according to the hearing ability of the respective hearing aid device wearer but also in a situation-specific fashion. To reduce the hearing effort and to increase the hearing comfort as well as the speech comprehensibility, signal processing concepts are provided which analyze noises and can adjust the signal processing to the respective noises. A distinction is herewith made inter alia between interference sound (generally ambient noises in everyday life) and useful sound (generally speech). The aim of most signal processing concepts is to achieve the best possible relationship between the useful and interference signal, in particular in order to increase the comprehensibility of speech. As the interference sound spectrum changes with each hearing situation, a standardized filtering of the interference sound is herewith not possible. Instead, special noise reduction methods are needed here, with the aid of which the incoming signals can be classified according to their interference noise part and can be individually attenuated.

Such noise reduction methods, methods based on the Wiener filter for instance, have already been used for some time in hearing devices. The signal-to-noise ratio of the input signal can herewith be improved significantly. However, a subjective improvement, in particular less hearing effort, is thus mainly achieved. It has still not been possible to achieve an objective improvement in speech comprehensibility in this way.

SUMMARY OF INVENTION

A negative effect for hearing-impaired persons is however that the noise reduction methods used can reduce soft (interference) signals to such a degree that the relevant signals are lowered to below the hearing threshold, particularly in the case of hearing-impaired persons with a significant hearing loss. Consequently, the hearing-impaired person is no longer able to perceive these signals. This behavior is however not desired for all signals. In particular, usual everyday noises, such as the gentle buzzing of an electrical device for instance, can no longer be heard as a result of this effect. This behavior which is typical of conventional noise reduction methods is frequently perceived by the people concerned to be interfering. By suppressing usual everyday noises, orientation in a known or unknown environment can also be rendered more difficult.

The object of the invention is thus to provide an improved noise reduction. This object is achieved by a method for noise reduction as well as by a noise reduction facility for a hearing aid device. Further advantageous embodiments of the invention are specified in the dependent claims.

According to the invention, a method for noise reduction in a hearing aid device is provided, with a signal, which comprises a useful and interference signal part, being processed in the hearing aid device, and with the interference signal part being reduced to the benefit of the useful signal part. In this process, the interference signal part is reduced as a function of the input level of the signal, with the interference signal part preferably being more heavily attenuated with a high input level than with a low input level. The input level-dependent attenuation ensures that interference signals, which, by virtue of an unfavorable signal-to-noise ratio would fall below the hearing threshold in the case of the conventional interference noise attenuation, also remain audible.

An advantageous embodiment of the invention provides that the attenuation of the signal is completely cancelled if the level of the interference signal part would fall below the hearing threshold due to a further attenuation.

This particularly easily ensures that a signal part which is classified as an interference noise still remains audible.

Provision is made in a further advantageous embodiment of the invention for the hearing threshold to be selected as a lower threshold value. This herewith ensures that a signal part, which is classified as an interference noise, still remains audible and that a maximum noise reduction effect is simultaneously achieved.

In a further particularly advantageous embodiment of the invention, provision is made for the audio signal in the hearing aid device to be split into at least two different frequency bands, which are each assigned to a frequency channel, with a signal of a frequency channel with a poorer signal-to-noise ratio being more heavily attenuated than a signal of a frequency channel with a better signal-to-noise ratio. Dividing the audio signal on different frequency channels enables a frequency-specific signal processing to be carried out. This allows an effective noise suppression to be realized.

Furthermore, a further advantageous embodiment of the invention provides that the attenuation of the signals is specifically carried out for each frequency channel, with the channel-specific attenuation of a signal on a frequency channel being completely cancelled if, by further attenuation, the level of the interference signal part on the corresponding frequency channel would fall below a lower threshold value which is predetermined for the corresponding frequency channel. Channel-specific attenuation cancellation enables an optimum interference noise reduction to be achieved with higher input levels on the one hand and on the other hand ensures that soft interference noises remain audible.

A further particularly advantageous embodiment of the invention provides that the cancellation of the attenuation of the signals on the individual frequency channels is adjusted to the individual hearing ability of the respective hearing aid wearer. In this process, a higher lower threshold value is selected for a frequency channel, whose frequencies are more poorly perceived by the hearing aid wearer than for a frequency channel whose frequencies are better perceived by the hearing aid wearer. Consideration of the individual hearing ability enables an even better optimum interference noise reduction to be achieved and simultaneously ensures that interference noises remain audible, i.e. lie above the hearing threshold of the hearing-impaired person.

In a further advantageous embodiment of the invention, provision is made for the lower threshold value to be determined for a frequency channel on the basis of the hearing threshold of the hearing aid wearer for the frequencies of the corresponding frequency channel. Information relating to the individual hearing ability of the hearing aid wearer is generally already stored in the hearing aid device, thereby herewith enabling the interference noise reduction to be optimized without any additional outlay.

Provision is finally made in an advantageous embodiment of the invention for the cancellation of the attenuation of a signal to take place only from an upper threshold value, with no cancellation of the attenuation taking place for signals, whose levels lie above the upper threshold value.

Particularly effective interference noise suppression is herewith possible.

BRIEF DESCRIPTION OF THE DRAWINGS

The invention is described in more detail below with reference to the drawings, in which.

DETAILED DESCRIPTION OF INVENTION

Figure 1:
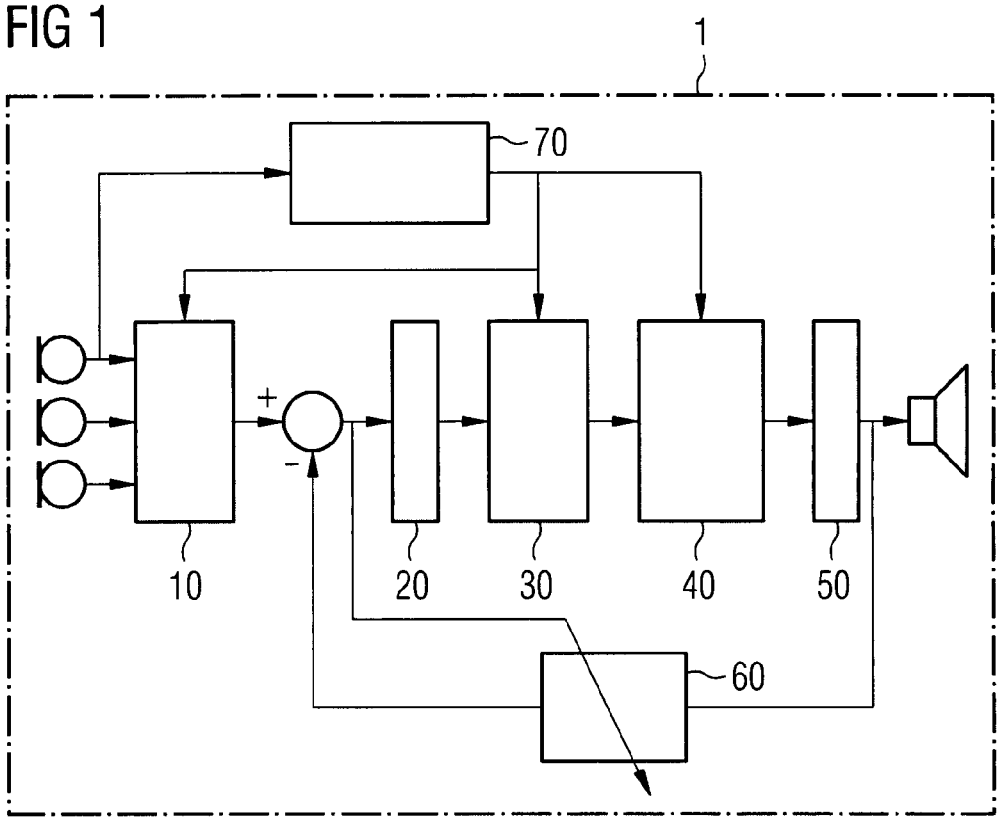
FIG. 1 shows a schematic representation of the design of a typical hearing aid device with a noise reduction facility.

FIG. 1 shows a typical hearing aid device 1, a hearing device for instance. The hearing device 1 comprises a microphone stage 10, which is embodied as a differential directional microphone system for instance. The output signal of the microphone stage 10, consisting of a useful (e.g. speech) and an interference signal, is typically divided into a number of frequency ranges (frequency bands) with the aid of a corresponding frequency analysis facility 20, said frequency ranges being further processed on different frequency channels. The audio signals of the different frequency channels then pass through a noise reduction facility 30, which is typically based on a Wiener filter. The signals of the different frequency bands are continuously weighted here according to their individual signal-to-noise ratio and the respective weighting is accordingly heavily attenuated in different ways. This herewith analyses whether the signals of the individual frequency channels comprise an almost identically remaining intensity (stationary) or appear in a modulated form (not stationary). Stationary signal parts, such as noises for instance, are interpreted as interference signals. In the relevant frequency band, the amplification is dropped relative to the other bands. Contrastingly, bands with modulated signal parts are understood to be speech components and are not attenuated.

The output signals of the noise reduction facility 30 then flow through a further signal processing component 40, in which they experience amplification and a dynamic compression.

Finally, the individual frequency bands are recombined in a frequency synthesis facility 50 and are output as an acoustic signal by way of an output converter, generally a loudspeaker. A typical hearing aid device 1 also comprises an adjustable facility 60 for reducing feedback effects, which inject the output signal of the hearing aid device 1 in a feedback loop back into the signal path of the audio signal. A classification system 70 is also provided, which decides, on the basis of the respective current hearing situation in each instance, which optimum adjustments of the hearing aid device 1, for instance which directional characteristics of the microphone stage 10 or which adaptation speed of the facility 60 for reducing feedback effects, are selected.

Figure 2:
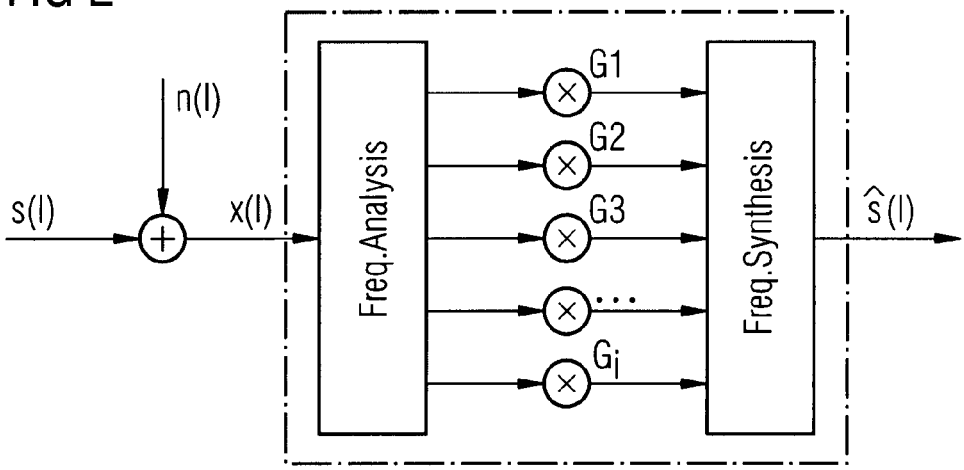
FIG. 2 shows a schematic representation of a typical noise reduction facility based on a Wiener filter.

With the noise reduction, the different frequency bands are heavily attenuated in different ways as a function of their respective signal-to-noise ratio. FIG. 2 clarifies by way of example the function of a noise reduction facility based on the Wiener filter. In this way, both a useful signal s(1) as well as an interference signal s(1) are present at a common input. The input signal x(1) which emanates from the combination of the useful signal s(1) and the interference signal n(1) is divided into different frequency bands by means of a frequency analysis, said frequency bands being assigned in each instance to a frequency channel i. For each frequency channel i, an individual weighting factor $G_i$ is determined and the signal of the respective frequency channel is attenuated with a corresponding attenuation factor. With the frequency synthesis, the differently weighted signals of the individual frequency channels i are recombined and output as a common output signal ŝ(1). The time dependency of the signals s(1), n(1) and x(1) is symbolized here by the variable 1.

The relationship between the weighting factor $G_i(l)$ of a specific frequency channel i and the signal-to-noise ratio on the respective frequency channel i is reproduced by the following equation:

$$G_i(l) = \frac{S_{ss,i}(l)}{S_{ss,i}(l) + S_{NN,i}(l)} = 1 - \frac{S_{NN,i}(l)}{S_{XX,i}(l)}$$

wherein $G_i(l)$: weighting factor of the frequency channel i, $S_{SS,i}(l)$: speech signal part in the respective frequency channel, $S_{NN,i}(l)$: interference signal part in the respective frequency channel, $S_{XX,i}(l)$: overall signal in the respective frequency channel.

With the conventional noise reduction, the weighting factor $G_i(l)$ of a frequency channel i thus depends directly on its signal-to-noise ratio. If the corresponding frequency channel i contains no interference signal ($S_{NN,i}(l)=0$), the attenuation is equal to zero (weighting factor 1). If the signal on the corresponding frequency channel i consists however of only one interference signal without a useful signal part ($S_{NN,i}(l)/S_{XX,i}(l)=1$), the weighting factor of the relevant frequency channel i is thus equal to zero. The maximum attenuation follows this frequency channel i.

As already shown, the different frequency bands in a conventional noise reduction facility 30 are only attenuated on the basis of their signal-to-noise ratio, i.e. such that a signal of a specific frequency band is attenuated all the more, the smaller its signal-to-noise ratio. With this noise reduction concept, signals which were however classified as interference signals are also subsequently attenuated and are however to be perceived by the hearing aid wearer as usual every day noises. The attenuation geared solely to the signal-to-noise ratio allows the signal level of these everyday noises to be reduced to such a degree that it falls below the hearing threshold. The hearing aid wearer is subsequently no longer able to perceive these usual everyday noises.

To prevent this negative effect, the effect of the noise reduction is adjusted as a function of the current input level of the hearing aid device 1 with the noise reduction method according to the invention. In particular, the possibility exists of canceling the noise reduction effect with low levels, i.e. to apply a lower attenuation. This effectively prevents the signals of different ambient noises from falling below the hearing threshold and thus no longer being able to be heard.

The attenuation can be cancelled in different ways. On the one hand, the attenuation values can be cancelled on the basis of a specific relationship to the input level. On the other hand, the cancellation of the attenuation values also allows for the individual hearing ability and/or individual hearing loss of the hearing aid wearer.

Figure 3:
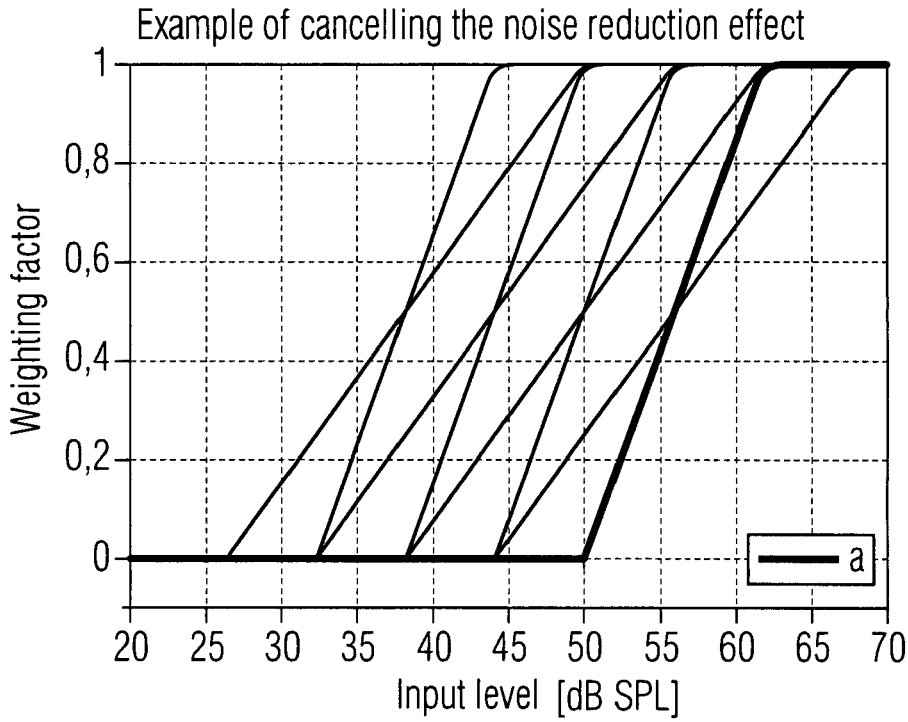
FIG. 3 shows a diagram for illustrating the dependency of the cancellation of the noise reduction effect on the input level.

If the attenuation values according to the first alternative are cancelled on the basis of a specific relationship to the input level, a number of such freely selectable interrelationships can also be provided. FIG. 3 shows a diagram with eight different characteristic curves, each of which illustrates a different dependency of the hearing device attenuation cancellation on the input level. The input level is plotted on the x-coordinate of the diagram, said input level corresponding to the acoustic performance data. In contrast, the noise reduction cancellation factor is shown on the y-coordinate of the diagram. This is the factor with which the noise reduction values (attenuation values in dB) are calculated multiplicatively. For instance, it is possible to infer from the diagram, on the basis of the characteristic curve a), that with corresponding adjustment of the noise reduction facility 30, the reduction of the noise reduction effect sets in only from an upper threshold value of approximately 62 dB. While full noise reduction is effective for input levels above 62 dB, the noise reduction effect below this upper threshold is preferably continuously reduced. The maximum reduction of the noise reduction effect is achieved here with a predetermined lower threshold value. In the present example, this threshold lies at 50 dB. Noise reduction no longer takes place below this lower threshold as the factor by which the noise reduction effect is cancelled with a corresponding input level here has a value of zero. Signals with an input level of 50 dB or less thus pass through the noise reduction facility 30 unattenuated, even if they comprise an unfavorable signal-to-noise ratio and thus would conventionally experience an attenuation. The lower threshold value is preferably selected here such that the corresponding signals still remain audible.

If the noise reduction facility 30 attenuates noises with an input level of more than 62 dB depending on the signal-to-noise ratio by −0 dB to −12 dB for the instance, the effect of the noise reduction reduces with a signal having an input level of approximately 56 dB by virtue of the input level-dependent attenuation reduction according to curve a) by a factor of approximately 0.5. The maximum attenuation of this signal subsequently only amounts to half of the original value, in other words −6 dB. As hitherto, the signal can preferably be attenuated here as a function of its signal-to-noise ratio, however only up to a maximum value of −6 dB.

A selection can be made, depending on requirements, between the individual relationships illustrated in FIG. 3 by the characteristic curves of the diagram. It is advantageous to select a suitable interrelationship already within the scope of a device adjustment and to store it in the respective device 1. The course and form of the corresponding curves can turn out very differently here depending on the application.

It is particularly advantageous if in the case of the cancellation of the attenuation values, the individual hearing ability and/or the individual hearing loss of the hearing aid wearer are also accounted for. To this end, it must be particularly ensured that the noise reduction attenuation is then cancelled when, due to its full effect, the output level of the hearing aid device would fall below the individual hearing threshold. This can and should preferably be carried out in a frequency-dependent manner, i.e. separately for each frequency band i. The knowledge of the individual hearing ability required herefor can be obtained by creating an audiogram prior to use. With a modern hearing device, this information is preferably already present in stored form, since the hearing loss is generally balanced here in a frequency-dependent manner. In this respect, it is possible to revert back to this information.

As previously conventional, the noise reduction effect is thus not only selected as a function of the signal-to-noise ratio, but additionally as a function of the input level and possibly also of the individual hearing loss of the respective hearing aid wearer. When considering the individual hearing loss, a lower threshold value geared to the individual hearing threshold is preferably predetermined in a frequency band-specific manner, below which threshold value the input level of the respective frequency channel is not permitted to drop.

With an input signal with a weak interference signal part, it can essentially also be meaningful to select the lower threshold such that the attenuation of the signal is already completely cancelled if the level of the interference signal part (in other words effectively the interference signal part of the input level) would drop below the hearing threshold, due to a further attenuation.

Figure 4:
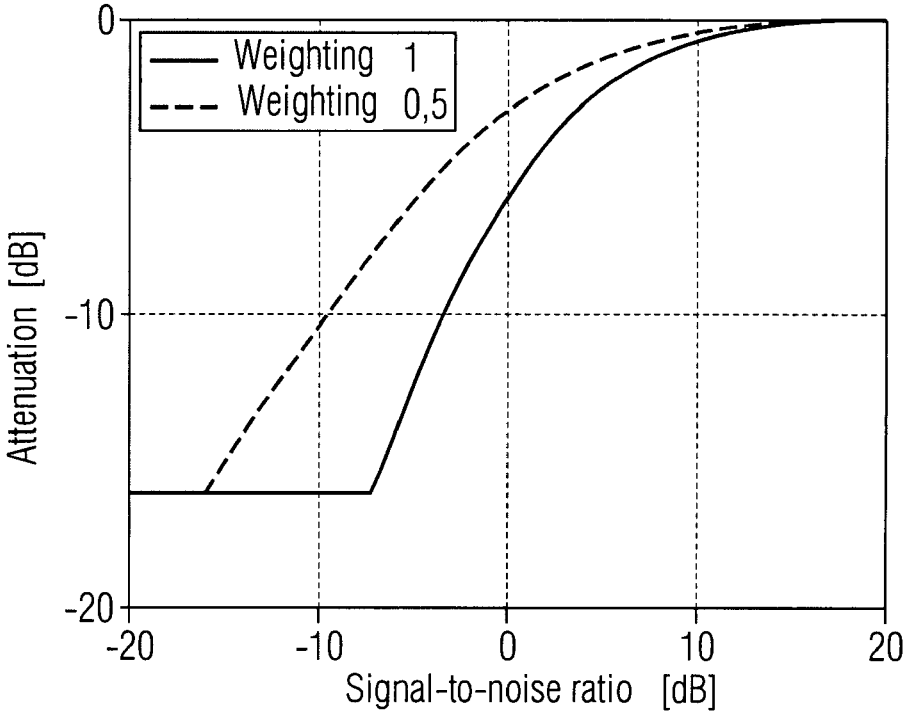
FIG. 4 shows a diagram to illustrate the dependency of the noise reduction attenuation on the signal-to-noise ratio.

The cancellation of the signal attenuation in the hearing aid device described here can be carried out by capping the maximum noise reduction value. This is herewith carried out in that only the maximum admissible attenuation value is multiplied by the respective attenuation reduction factor, whereas the attenuation to this maximum attenuation value is carried out as previously. It is also possible to apply the respective attenuation reduction factor to each attenuation value between zero and the maximum attenuation value. The slope of the corresponding characteristic curve is herewith reduced, which reproduces the interrelationship between the determined signal-to-noise ratio and the corresponding attenuation value. This relationship is shown by way of example in FIG. 4. A combination of these two methods is also essentially possible, so that the corresponding characteristic curve takes a flatter course and the maximum attenuation value is in addition also capped.

All methods indicated here result in the maximum attenuation value being reduced as a function of the input level and if necessary also as a function of the individual hearing loss, and effective preventative measures are thus taken to ensure that desired everyday noises fall below the hearing threshold. To what extent one of these methods or a combination thereof is implemented in a hearing aid device depends primarily on the respective application.

The features of the invention disclosed in the preceding description, claims and drawings can be essential, both individually and also in any combination, in implementing the invention in its different embodiments.

The invention claimed is:

1. A method for noise reduction in a hearing aid device, comprising:

a signal having a useful signal part and an interference signal part, wherein the signal is processed in the hearing aid device, wherein the interference signal part is reduced as a function of an input level of the signal, and wherein the interference signal part being more heavily attenuated with a high input level than with a low input level, wherein the attenuation of the signal is completely cancelled if the input level or the interference signal part of the input level would drop below a predetermined lower threshold value due to a further attenuation.

2. The method as claimed in claim 1, wherein the hearing threshold is selected as the lower threshold value.

3. A method for noise reduction in a hearing aid device, comprising:

a signal having a useful signal part and an interference signal part, wherein the signal is processed in the hearing aid device, wherein the interference signal part is reduced as a function of an input level of the signal, and wherein the interference signal part being more heavily attenuated with a high input level than with a low input level, wherein the signal in the hearing aid device is divided on at least two frequency channels with a different frequency band in each instance, with a signal on a first frequency channel, comprising a poorer signal-to-noise ratio, being more heavily attenuated than a signal on a second frequency channel, comprising an improved signal-to-noise ratio.

4. The method as claimed in claim 3, wherein the attenuation of the signals is carried out specifically for each frequency channel, wherein the channel-specific attenuation of a signal on a frequency channel being completely cancelled when due to a further attenuation the input level on the corresponding frequency channel or the interference signal part of the input level on the corresponding frequency channel would fall below a lower threshold value which was predetermined for the corresponding frequency channel.

5. The method as claimed in claim 3, wherein the cancellation of the attenuation of the signals on the individual frequency channels is adjusted to the individual hearing ability of the respective hearing aid wearer, with a higher lower threshold value being selected for a frequency channel whose frequencies are perceived more poorly by the hearing aid wearer than for a frequency channel whose frequencies are better perceived by the hearing aid wearer.

6. The method as claimed in claim 4, wherein the lower threshold value is determined for a frequency channel on the basis of the hearing threshold of the hearing aid wearer for the frequencies of the corresponding frequency channel.

7. The method as claimed in claim 4, wherein the cancellation of the attenuation of a signal is only carried out from an upper threshold value, with no cancellation of the attenuation being carried out for the signals whose levels lie above the upper threshold.

8. The method as claimed in claim 4, wherein the signal is attenuated as a function of its signal-to-noise ratio, when the signal comprises a high signal-to-noise ratio with the signal is not attenuated and when the signal comprises a low signal-to-noise ratio the signal being attenuated to a maximum.

9. A hearing aid device, comprising:

a signal comprising a useful signal part and an interference signal part; and a noise reduction facility to reduce the interference signal part to the benefit of the useful signal part, wherein the noise reduction facility adjusts the attenuation of the interference signal part as a function of an input level of the signal, and wherein the noise reduction facility attenuates more heavily the interference signal part with a high input level than with a low input level, and wherein the noise reduction facility completely cancels the attenuation of the signal when the input level or the interference signal part of the input level would fall below a predetermined lower threshold value due to a further attenuation.

10. The hearing aid device as claimed in claim 9, wherein a hearing threshold is used as a lower threshold value.

11. The hearing aid device as claimed in one of claim 10, wherein the signal in the hearing aid device is processed in at least two frequency channels with a different frequency band in each instance, wherein the noise reduction facility more heavily attenuates a signal on a first frequency channel which comprises a poorer signal-to-noise ratio than a signal on second frequency channel which comprises a better signal-to-noise ratio.

12. The hearing aid device as claimed in claim 11, wherein the noise reduction facility carries out the attenuation of the signals for each frequency channel, wherein the channel-specific attenuation of a signal on a frequency channel being completely cancelled when, due to a further attenuation, the input level on the corresponding frequency channel or the interference signal part of the input level on the corresponding frequency channel would fall below a lower threshold value which was predetermined for the corresponding frequency channel.

13. The hearing aid device as claimed in claim 11, wherein the noise reduction facility adjusts the cancellation of the attenuation of the signals on the individual frequency channels to an individual hearing ability of a respective hearing aid wearer for a frequency channel whose frequencies are perceived more poorly by the hearing aid wearer, wherein a higher lower threshold value being selected than for a frequency channel whose frequencies are better perceived by the hearing aid wearer.

14. The hearing aid device as claimed in claim 13, wherein the noise reduction facility determines the lower threshold value for a frequency channel based on the threshold of the hearing aid wearer for the frequencies of the corresponding frequency channel.

15. The hearing aid device as claimed in claim 13, the noise reduction facility carries out the cancellation of the attenuation of a signal from an upper threshold value such that no cancellation of the attenuation is carried out for the signals whose levels lie above the upper threshold value.

16. The hearing aid device as claimed in claim 13, wherein the noise reduction facility attenuates the signal as a function of its signal-to-noise ratio such that when the signal with a high signal-to-noise ratio is not attenuated and the signal with a low signal-to-noise ratio is attenuated to a maximum.

* * * * *